US005578976A

United States Patent [19]

Yao

[11] Patent Number: 5,578,976

[45] Date of Patent: Nov. 26, 1996

[54] MICRO ELECTROMECHANICAL RF SWITCH

[75] Inventor: Jun J. Yao, Thousand Oaks, Calif.

[73] Assignee: Rockwell International Corporation, Seal Beach, Calif.

[21] Appl. No.: 493,445

[22] Filed: Jun. 22, 1995

[51] Int. Cl.[6] ..... H01P 1/10; H01H 57/00

[52] U.S. Cl. ..... 333/262; 200/181

[58] Field of Search ..... 333/101, 105, 333/262; 310/309; 200/181, 245, 246

[56] References Cited

U.S. PATENT DOCUMENTS

| | | | |
|---|---|---|---|
| 4,922,253 | 5/1990 | Nathanson et al. | 333/105 X |
| 5,168,249 | 12/1992 | Larson | 333/262 X |
| 5,258,591 | 11/1993 | Buck | 200/181 |
| 5,367,136 | 11/1994 | Buck | 200/181 X |

OTHER PUBLICATIONS

Micromechanical Thermometer with $10^{-3}$K to $10^{2}$K Range, IBM Technical Disclosure Bulletin, vol. 29, No. 7, Dec. 1986, pp. 2842, 2843.

Peterson, "Micromechanical Membrane Switches on Silicon," *IBM J. Res. Develop.*, vol. 23, No. 4, pp. 376–384, Jul. 1979.

Grétillat et al., "Electrostatic Polysilicon Microrelays Integrated with MOSFETs," *Proc. IEEE MEMS Workshop*, pp. 97–101, 1994. no month.

*Primary Examiner*—Paul Gensler
*Attorney, Agent, or Firm*—John C. McFarren

[57] ABSTRACT

A micro electromechanical RF switch is fabricated on a substrate using a suspended microbeam as a cantilevered actuator arm. From an anchor structure, the cantilever arm extends over a ground line and a gapped signal line that comprise microstrips on the substrate. A metal contact formed on the bottom of the cantilever arm remote from the anchor is positioned facing the signal line gap. An electrode atop the cantilever arm forms a capacitor structure above the ground line. The capacitor structure may include a grid of holes extending through the top electrode and cantilever arm to reduce structural mass and the squeeze damping effect during switch actuation. The switch is actuated by application of a voltage on the top electrode, which causes electrostatic forces to attract the capacitor structure toward the ground line so that the metal contact closes the gap in the signal line. The switch functions from DC to at least 4 GHz with an electrical isolation of –50 dB and an insertion loss of 0.1 dB at 4 GHz. A low temperature fabrication process allows the switch to be monolithically integrated with microwave and millimeter wave integrated circuits (MMICs). The RF switch has applications in telecommunications, including signal routing for microwave and millimeter wave IC designs, MEMS impedance matching networks, and band-switched tunable filters for frequency-agile communications.

19 Claims, 2 Drawing Sheets

MICRO ELECTROMECHANICAL RF SWITCH

TECHNICAL FIELD

The present invention relates to micro electromechanical systems (MEMS) and, in particular, to a micromachined electromechanical RF switch that functions with signal frequencies from DC up to at least 4 GHz.

BACKGROUND OF THE INVENTION

Electrical switches are widely used in microwave and millimeter wave integrated circuits (MMICs) for many telecommunications applications, including signal routing devices, impedance matching networks, and adjustable gain amplifiers. State of the art technology generally relies on compound solid state switches, such as GaAs MESFETs and PIN diodes, for example. Conventional RF switches using transistors, however, typically provide low breakdown voltage (e.g., 30 V), relatively high on-resistance (e.g., 0.5 Ω), and relatively low off-resistance (e.g., 50 kΩ at 100 MHz). When the signal frequency exceeds about 1 GHz, solid state switches suffer from large insertion loss (typically on the order of 1 dB) in the "On" state (i.e., closed circuit) and poor electrical isolation (typically no better than −30 dB) in the "Off" state (i.e., open circuit).

Switches for telecommunications applications require a large dynamic range between on-state and off-state impedances in the RF regime. RF switches manufactured using micromachining techniques can have advantages over conventional transistors because they function more like macroscopic mechanical switches, but without the bulk and high cost. Micromachined, integrated RF switches are difficult to implement, however, because of the proximity of the contact electrodes to each other. Achieving a large off/on impedance ratio requires a good electrical contact with minimal resistance when the switch is on (closed circuit) and low parasitic capacitive coupling when the switch is off (open circuit). In the RF regime, close electrode proximity allows signals to be coupled between the contact electrodes when the switch is in the off-state, resulting in low off-state resistance. Lack of dynamic range in on to off impedances for frequencies above 1 GHz is the major limitation of conventional transistor-based switches and known miniature electromechanical switches and relays. Thus, there is a need in telecommunications systems for micro electromechanical switches that provide a wide dynamic impedance range from on to off at signal frequencies from DC up to at least 4 GHz.

SUMMARY OF THE INVENTION

The present invention comprises a microfabricated, miniature electromechanical RF switch capable of handling GHz signal frequencies while maintaining minimal insertion loss in the "On" state and excellent electrical isolation in the "OFF" state. In a preferred embodiment, the RF switch is fabricated on a semi-insulating gallium-arsenide (GaAs) substrate with a suspended silicon dioxide micro-beam as a cantilevered actuator arm. The cantilever arm is attached to an anchor structure so as to extend over a ground line and a gapped signal line formed by metal microstrips on the substrate. A metal contact, preferably comprising a metal that does not oxidize easily, such as platinum, gold, or gold palladium, is formed on the bottom of the cantilever arm remote from the anchor structure and positioned above and facing the gap in the signal line. A top electrode on the cantilever arm forms a capacitor structure above the ground line on the substrate. The capacitor structure may include a grid of holes extending through the top electrode and cantilever arm. The holes, preferably having dimensions comparable to the gap between the cantilever arm and the bottom electrode, reduce structural mass and the squeeze film damping effect of air between the cantilever arm and the substrate during switch actuation. The switch is actuated by application of a voltage to the top electrode. With voltage applied, electrostatic forces attract the capacitor structure toward the ground line, thereby causing the metal contact to close the gap in the signal line. The switch functions from DC to at least 4 GHz with an electrical isolation of −50 dB and an insertion loss of 0.1 dB at 4 GHz. A low temperature process (250° C.) using five photo-masks allows the switch to be monolithically integrated with microwave and millimeter wave integrated circuits (MMICs). The micro electromechanical RF switch has applications in telecommunications, including signal routing for microwave and millimeter wave IC designs, MEMS impedance matching networks, and band-switched tunable filters for frequency-agile communications.

As demonstrated in a prototype of the present invention, the micro electromechanical RF switch can be switched from the normally off-state (open circuit) to the on-state (closed circuit) with 28 volts (~50 nA or 1.4 μW) and maintained in either state with nearly zero power. In ambient atmosphere, closure time of the switch is on the order of 30 μs. The silicon dioxide cantilever arm of the switch has been stress tested for sixty-five billion cycles ($6.5\times10^{10}$) with no observed fatigue effects. With cross sectional dimensions of the narrowest gold line at 1 μm×20 μm, the switch can handle a current of at least 250 mA.

A principal object of the invention is an RF switch that has a large range between on-state and off-state impedances at GHz frequencies. A feature of the invention is a micromachined switch having an electrostatically actuated cantilever arm. An advantage of the invention is a switch that functions from DC to RF frequencies with high electrical isolation and low insertion loss.

BRIEF DESCRIPTION OF THE DRAWINGS

For a more complete understanding of the present invention and for further advantages thereof, the following Detailed Description of the Preferred Embodiments makes reference to the accompanying Drawings, in which.

DETAILED DESCRIPTION OF THE PREFERRED EMBODIMENTS

Figure 1:
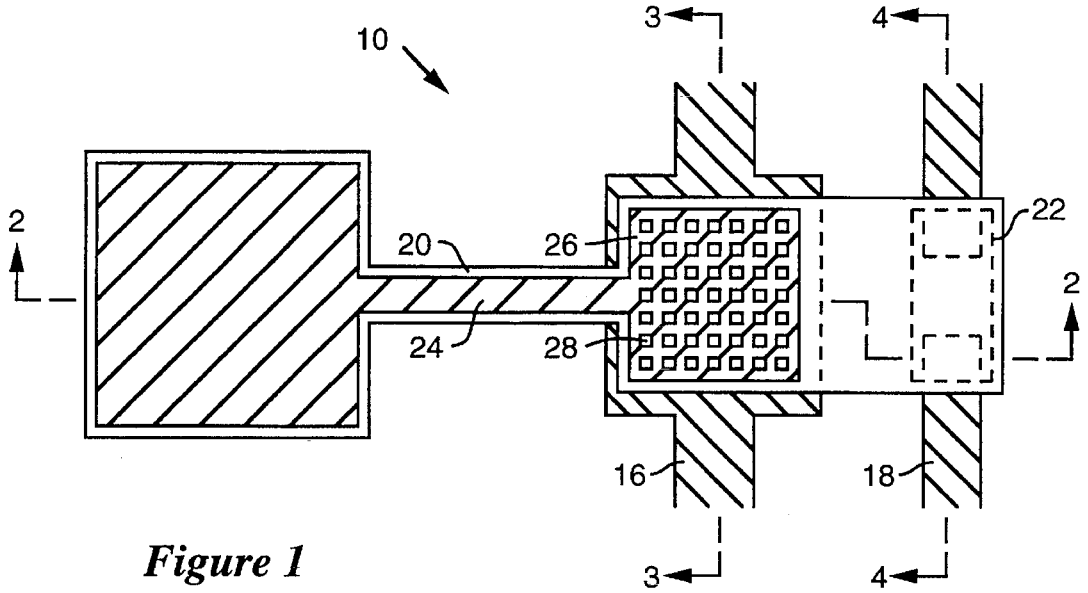
FIG. 1 is a top plan view of a micro electromechanical switch of the present invention.
Figure 2:
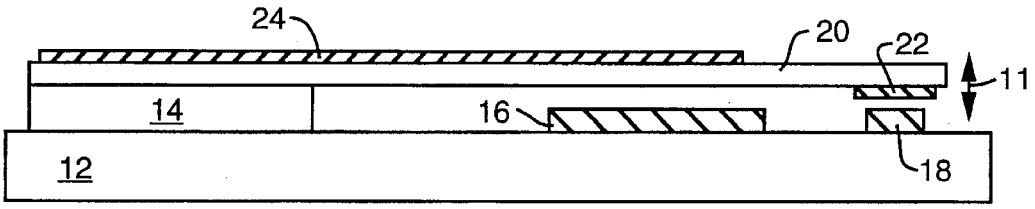
FIG. 2 is a cross section of the switch of FIG. 1 taken along the section line 2—2.
Figure 3:
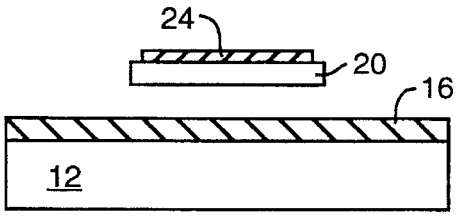
FIG. 3 is a cross section of the switch of FIG. 1 taken along the section line 3—3.
Figure 4:
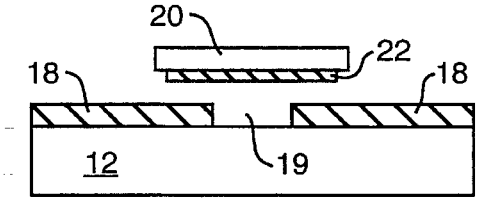
FIG. 4 is a cross section of the switch of FIG. 1 taken along the section line 4—4.
Figure 5A:
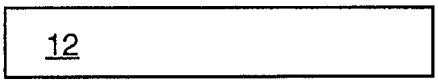
FIGS. 5A–E are cross sections illustrating the steps in fabricating the section of the switch shown in FIG. 3.

The present invention comprises a miniature RF switch designed for applications with signal frequencies from DC up to at least 4 GHz. FIG. 1 shows a schematic top plan view of an electromechanical RF switch 10 micromachined on a substrate. FIGS. 2, 3, and 4 show cross sections of switch 10 taken along the section lines 2—2, 3—3, and 4—4, respectively, of FIG. 1. Micromachined miniature switch 10 has applications in telecommunications systems including signal routing for microwave and millimeter wave IC designs, MEMS impedance matching networks, and adjustable gain amplifiers.

In a preferred embodiment, switch 10 is fabricated on a substrate 12, such as a semi-insulating GaAs substrate, for example, using generally known microfabrication techniques, such as masking, etching, deposition, and lift-off. Switch 10 is attached to substrate 12 by an anchor structure 14, which may be formed as a mesa on substrate 12 by deposition buildup or etching away surrounding material, for example. A bottom electrode 16, typically connected to ground, and a signal line 18 are also formed on substrate 12. Electrode 16 and signal line 18 generally comprise microstrips of a metal not easily oxidized, such as gold, for example, deposited on substrate 12. Signal line 18 includes a gap 19, best illustrated in FIG. 4, that is opened and closed by operation of switch 10, as indicated by arrow 11.

The actuating part of switch 10 comprises a cantilevered arm 20, typically formed of a semiconducting, semi-insulating, or insulating material, such as silicon dioxide or silicon nitride, for example. Cantilever arm 20 forms a suspended micro-beam attached at one end atop anchor structure 14 and extending over and above bottom electrode 16 and signal line 18 on substrate 12. An electrical contact 22, typically comprising a metal, such as gold, platinum, or gold palladium, for example, that does not oxidize easily, is formed on the end of cantilever arm 20 remote from anchor structure 14. Contact 22 is positioned on the bottom side of cantilever arm 20 so as to face the top of substrate 12 over and above gap 19 in signal line 18.

A top electrode 24, typically comprising a metal such as aluminum or gold, for example, is formed atop cantilever arm 20. Top electrode 24 starts above anchor structure 14 and extends along the top of cantilever arm 20 to end at a position above bottom electrode 16. Cantilever arm 20 and top electrode 24 are broadened above bottom electrode 16 to form a capacitor structure 26. As an option to enhance switch actuation performance, capacitor structure 26 may be formed to include a grid of holes 28 extending through top electrode 24 and cantilever arm 20. The holes, typically having dimensions of 1–100 μm, for example, reduce structural mass of cantilever arm 20 and the squeeze film damping effect of air during actuation of switch 10, as indicated by arrow 11.

In operation, switch 10 is normally in an "Off" position as shown in FIG. 2. With switch 10 in the off-state, signal line 18 is an open circuit due to gap 19 and the separation of contact 22 from signal line 18. Switch 10 is actuated to the "On" position by application of a voltage on top electrode 24. With a voltage on top electrode 24 and capacitor structure 26, which is a separated from bottom electrode 16 by insulating cantilever arm 20, electrostatic forces attract capacitor structure 26 (and cantilever arm 20) toward bottom electrode 16. Actuation of cantilever arm 20 toward bottom electrode 16, as indicated by arrow 11, causes contact 22 to come into contact with signal line 18, thereby closing gap 19 and placing signal line 18 in the on-state state (i.e., closing the circuit).

DESIGN TRADE-OFFS

The following description sets forth, by way of example, and not limitation, various component dimensions and design trade-offs in constructing micro electromechanical switch 10. For the general design of RF switch 10, silicon dioxide cantilever arm 20 is typically 10 to 1000 μm long, 1 to 100 μm wide, and 1 to 10 gm thick. Capacitor structure 26 has a typical area of 100 $\mu m^2$ to 1 $mm^2$. The gap between the bottom of silicon dioxide cantilever arm 20 and metal lines 16 and 18 on substrate 12 is typically 1–10 μm. Gold microstrip signal line 18 is generally 1–10 μm thick and 10–1000 μm wide to provide the desired signal line impedance. Gold contact 22 is typically 1–10 μm thick with a contact area of 10–10,000 $\mu m^2$.

At low signal frequencies, insertion loss of switch 10 is dominated by the resistive loss of signal line 18, which includes the resistance of signal line 18 and resistance of contact 22. At higher frequencies, insertion loss can be attributed to both resistive loss and skin depth effect. For frequencies below 4 GHz, skin depth effect is much less significant than resistive loss of signal line 18. To minimize resistive loss, a thick layer of gold (2 μm, for example) can be used. Gold is also preferred for its superior electromigration characteristics. The width of signal line 18 is more limited than its thickness because wider signal lines, although generating lower insertion loss, produce worse off-state electrical isolation due to the increased capacitive coupling between the signal lines. Furthermore, a change in microstrip signal line dimensions also affects microwave impedance.

Electrical isolation of switch 10 in the off-state mainly depends on the capacitive coupling between the signal lines or between the signal lines and the substrate, whether the substrate is conductive or semi-conductive. Therefore, a semi-insulating GaAs substrate is preferred over a semiconducting silicon substrate for RF switch 10. GaAs substrates are also preferred over other insulating substrates, such as glass, so that RF switch 10 may retain its monolithic integration capability with MMICs.

Capacitive coupling between signal lines may be reduced by increasing the gap between signal line 18 on substrate 12 and metal contact 22 on the bottom of suspended silicon dioxide cantilever arm 20. However, an increased gap also increases the voltage required to actuate switch 10 because the same gap affects the capacitance of structure 26. Aluminum top metal 24 of capacitor structure 26 couples to the underlying ground metallization 16. For a fixed gap distance, the voltage required to actuate switch 10 may be reduced by increasing the area of actuation capacitor structure 26. However, an increase in capacitor area increases the overall mass of the suspended structure and thus the closure time of switch 10. If the stiffness of the suspended structure is increased to compensate for the increase in structure mass so as to maintain a constant switch closure time, the voltage required to actuate switch 10 will be further increased. Furthermore, in order to obtain minimal insertion loss, contact 22 on silicon dioxide cantilever arm 20 also needs to be maximized in thickness to reduce resistive loss, but a thick gold contact 22 also contributes to overall mass.

In managing the tradeoffs between device parameters for RF switch 10, insertion loss and electrical isolation are generally given the highest priority, followed by closure time and actuation voltage. In preferred embodiments, insertion loss and electrical isolation of RF switch 10 are designed to be 0.1 dB and −50 dB at 4 GHz, respectively, while switch closure time is on the order of 30 μs and actuation voltage is 28 Volts.

The optional grid of holes 28 in actuation capacitor structure 26 reduces structural mass while maintaining overall actuation capacitance by relying on fringing electric fields of the grid structure. In addition, the grid of holes 28 reduces the atmospheric squeeze film damping effect between cantilever arm 20 and substrate 12 as switch 10 is actuated. Switches without a grid of holes 28 generally have much greater-closing and opening times due to the squeeze film damping effect.

FABRICATION

RF switch 10 of the present invention is manufactured by surface microfabrication techniques using five masking levels. No critical overlay alignment is required. The starting substrate for the preferred embodiment is a 3-inch semi-insulating GaAs wafer. Silicon dioxide ($SiO_2$) deposited using plasma enhanced chemical vapor deposition (PECVD) is used as the preferred structural material for cantilever arm 20, and polyimide is used as the preferred sacrificial material. FIGS. 5A–E and 6A–E are cross-sectional schematic illustrations of the process sequence as it affects sections 3—3 and 4—4, respectively, of switch 10 shown in FIG. 1. The low process temperature of 250° C. during $SiO_2$ PECVD forming of switch 10 ensures monolithic integration capability with MMICs.

Anchor structure 14 may be fabricated using many different etching and/or depositing techniques. Forming raised anchor structure 14 as illustrated in FIG. 2 typically requires the anchor area to be much larger than the dimensions of cantilever arm 20. In one method, cantilever arm 20 is formed atop a sacrificial layer deposited on substrate 12. When cantilever arm 20 is released, by using oxygen plasma, for example, to remove the sacrificial layer laterally, the sacrificial material forming anchor structure 14 is undercut but not removed completely. In another method, an etching step prior to the deposition of the material forming cantilever arm 20 is used to create a recessed area in the sacrificial layer where anchor structure 14 will be formed. In this configuration, the material of cantilever arm 20 is actually deposited on substrate 12 in the etched recessed area of the sacrificial layer to form anchor structure 14.

Figure 6A:
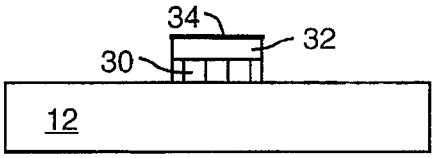
FIGS. 6A–E are cross sections illustrating the steps in fabricating the section of the switch shown in FIG. 4.
Figure 5B:
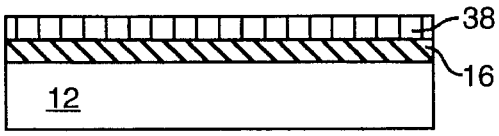
Figure 6B:
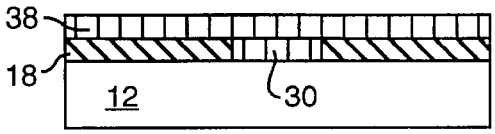
Figure 5C:
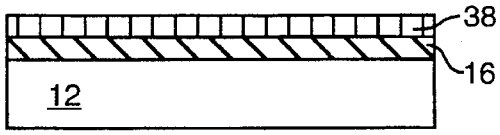

In forming cantilever arm 20, electrodes 16 and 18, and contact 22, a sacrificial material, such as a layer of thermal setting polyimide 30 (such as DuPont PI2556, for example), is deposited on substrate 12. Polyimide may be cured with it sequence of oven bakes at temperatures no higher than 250° C. A second sacrificial material, such as a layer of pre-imidized polyimide 32 (such as OCG Probeimide 285, for example) that can be selectively removed from the first sacrificial material, is then deposited. OCG Probeimide 285 can be spun on and baked with a highest baking temperature of 170° C. A 1500 Å thick silicon nitride layer 34 is then deposited and patterned using photolithography and reactive ion etch (RILE) in $CHF_3$ and $O_2$ chemistry. The pattern is further transferred to the underlying polyimide layers via $O_2$ RIE, as best illustrated in FIG. 6A. This creates a liftoff profile similar to a tri-layer resist system except that two layers of polyimide are used. A layer of gold is electron beam evaporated with a thickness equal to that of the thermal set polyimide layer 30 to form bottom electrode 16 and signal line 18, as shown in FIGS. 5B and 6B. Gold liftoff is completed using methylene chloride to dissolve the pre-imidized OCG polyimide, leaving a planar gold/polyimide surface, as best illustrated in FIG. 6B. The cross linked DuPont polyimide 30 has good chemical resistance to methylene chloride.

Figure 6C:
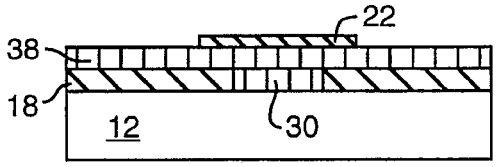
Figure 5D:
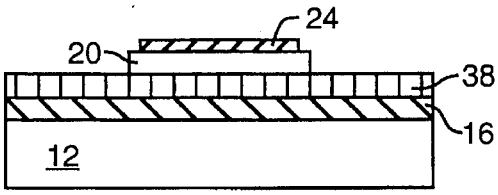
Figure 6D:
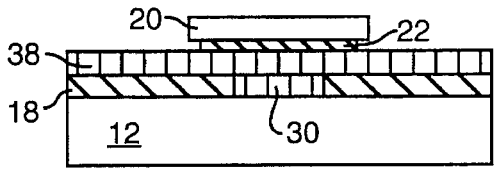
Figure 5E:
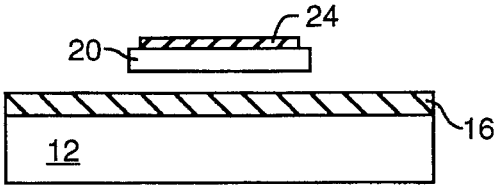
Figure 6E:
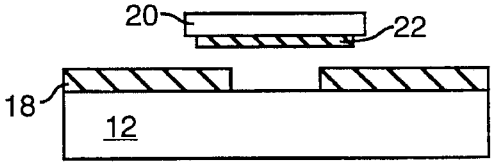

A second layer of thermal setting polyimide 38 (such as DuPont PI2555, for example) is spun on and thermally cross linked. A layer of 1 μm gold is deposited using electron beam evaporation and liftoff to form contact metal 22, as best shown in FIG. 6C. A 2 μm thick layer of PECVD silicon dioxide film is then deposited and patterned using photolithography and RIE in $CHF_3$ and $O_2$ chemistry to form cantilever arm 20, as shown in FIGS. 5D and 6D. A thin layer (2500 Å) of aluminum film is then deposited using electron beam evaporation and liftoff to form top electrode 24 in the actuation capacitor structure, as shown in FIG. 5D. Finally, the entire RF switch structure is released by dry etching the polyimide films 30 and 38 in a Branson $O_2$ barrel etcher. Dry-release is preferred over wet chemical release methods to aa prevent potential sticking problems.

TEST RESULTS

Stiffness of the suspended switch structure fabricated as described above is designed to be 0.2–2.0 N/m for various cantilever dimensions. The lowest required actuation voltage is 28 Volts, with an actuation current on the order of 50 nA (which corresponds to a power consumption of 1.4 μW). Electrical isolation of −50 dB and insertion loss of 0.1 dB at 4 GHz have been achieved. Because of electrostatic actuation, switch 10 requires nearly zero power to maintain its position in either the on-state or the off-state. Switch closure time is on the order of 30 μs. The silicon dioxide cantilever arm 20 has been stress tested for a total of sixty five billion cycles ($6.5\times10^{10}$) with no observed fatigue effects. The current handling capability for the prototype switch 10 was 200 μA with the cross sectional dimensions of the narrowest gold signal line 18 being 1 μm by 20 μm. The DC resistance of the prototype switch was 0.22 Ω. All characterizations were performed in ambient atmosphere.

Although the present invention has been described with respect to specific embodiments thereof, various changes and modifications can be carried out by those skilled in the art without departing from the scope of the invention. In particular, the substrate, anchor structure, cantilever arm, electrodes, and metal contact may be fabricated using any of various materials appropriate for a given end use design. The anchor structure, cantilever arm, capacitor structure, and metal contact may be formed in various geometries, including multiple anchor points, cantilever arms, and metal contacts. It is intended, therefore, that the present invention encompass such changes and modifications as fall within the scope of the appended claims.

I claim:

1. A micro electromechanical switch formed on a substrate, comprising:

an anchor structure, a bottom electrode, and a signal line formed on the substrate;

said signal line having a gap forming an open circuit;

a cantilever arm formed of insulating material attached to said anchor structure and extending over said bottom electrode and said signal line gap;

an electrical contact formed on said cantilever arm remote from said anchor structure and positioned facing said gap in said signal line;

a top electrode formed atop said cantilever arm; and a portion of said cantilever arm and said top electrode positioned above said bottom electrode forming a capacitor structure electrostatically attractable toward said bottom electrode upon selective application of a voltage on said top electrode.

2. The micro electromechanical switch of claim 1, wherein said electrostatic attraction of said capacitor structure toward said bottom electrode causes said electrical contact on said cantilever arm to close said gap in said signal line.

3. The micro electromechanical switch of claim 1, wherein said substrate comprises a semi-insulating GaAs substrate.

4. The micro electromechanical switch of claim 1, wherein said cantilever arm comprises silicon dioxide.

5. The micro electromechanical switch of claim 1, wherein said capacitor structure further comprises a grid of holes extending through said cantilever arm and top electrode.

6. A micro electromechanical RF switch formed on a substrate, comprising:

an anchor structure, a bottom electrode, and a signal line formed on the substrate;

said signal line having a gap forming an open circuit;

a cantilever arm attached to said anchor structure and extending over said bottom electrode and said signal line gap;

a metal contact formed on said cantilever and remote from said anchor structure and positioned facing said gap in said signal line;

a top electrode formed on said cantilever arm and extending to a position opposite said bottom electrode;

a portion of said cantilever arm and said top electrode positioned opposite said bottom electrode forming a capacitor structure;

said capacitor structure having a grid of holes extending through said cantilever arm and top electrode; and a voltage selectively applied to said top electrode generating an electrostatic force attracting said capacitor structure toward said bottom electrode thereby causing said metal contact on said cantilever arm to close said gap in said signal line.

7. The micro electromechanical RF switch of claim 6, wherein said substrate comprises a semi-insulating substrate.

8. The micro electromechanical RF switch of claim 7, wherein said semi-insulating substrate comprises a semi-insulating GaAs substrate.

9. The micro electromechanical RF switch of claim 6, wherein said cantilever arm is formed of silicon dioxide.

10. The micro electromechanical RF switch of claim 6, wherein said grid of holes extending through said cantilever arm and top electrode reduce structural mass and the squeeze film damping effect during actuation of the switch.

11. A micro electromechanical RF switch formed on a substrate, comprising:

an anchor structure, a metal bottom electrode, and a metal signal line formed on the substrate;

said signal line having a gap forming an open circuit;

a cantilever arm formed of insulating material attached to said anchor structure and extending over said bottom electrode and said signal line gap;

a metal contact formed on said cantilever arm remote from said anchor structure and positioned facing said gap in said signal line;

a metal top electrode formed atop said cantilever arm and extending to a position opposite said bottom electrode;

a capacitor structure comprising a portion of said cantilever arm and said top electrode positioned opposite said bottom electrode, said capacitor structure having a grid of holes extending through said cantilever arm and top electrode; and the switch actuatable by a voltage selectively applied to said top electrode for generating an electrostatic force to attract said capacitor structure toward said bottom electrode and thereby close said gap in said signal line with said metal contact on said cantilever arm.

12. The micro electromechanical RF switch of claim 11, wherein said substrate comprises semi-insulating substrate.

13. The micro electromechanical RF switch of claim 12, wherein said semi-insulating substrate comprises a semi-insulating GaAs substrate.

14. The micro electromechanical RF switch of claim 11, wherein said insulating material forming said cantilever arm comprises silicon dioxide.

15. The micro electromechanical RF switch of claim 11, wherein said grid of holes extending through said cantilever arm and top electrode reduces structural mass and the squeeze film damping effect of air during actuation of the switch.

16. The micro electromechanical RF switch of claim 11, wherein said bottom electrode and signal line comprise gold microstrips on the substrate.

17. The micro electromechanical RF switch of claim 11, wherein said metal contact comprises a metal selected form the group consisting of gold, platinum, and gold palladium.

18. The micro electromechanical RF switch of claim 11, wherein said cantilever arm has a thickness in the range of 1–10 μm.

19. The micro electromechanical RF switch of claim 11, wherein said cantilever arm has a length from anchor structure to capacitor structure in the range of 10–1000 μm.

* * * * *